US008204391B2

(12) United States Patent
Okano

(10) Patent No.: US 8,204,391 B2
(45) Date of Patent: Jun. 19, 2012

(54) IMAGE FORMING APPARATUS WHICH CHANGES JAM DETERMINATION CRITERION

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 462 days.

(21) Appl. No.: 12/566,614

(22) Filed: Sep. 24, 2009

(65) Prior Publication Data

US 2010/0074636 A1 Mar. 25, 2010

(30) Foreign Application Priority Data

Sep. 24, 2008 (JP) ..... 2008-244500

(51) Int. Cl.
*G03G 15/00* (2006.01)

(52) U.S. Cl. ..... 399/21; 399/22; 399/405

(58) Field of Classification Search ..... 399/21, 399/22, 18, 405
See application file for complete search history.

(56) References Cited

U.S. PATENT DOCUMENTS

| | | | | |
|---|---|---|---|---|
| 6,177,977 | B1 | 1/2001 | Tanaka et al. | |
| 7,024,124 | B2 | 4/2006 | Taguchi et al. | |
| 2003/0151764 | A1* | 8/2003 | Uchida | 358/1.14 |
| 2005/0191066 | A1* | 9/2005 | Yamazaki | 399/21 |

FOREIGN PATENT DOCUMENTS

| | | | |
|---|---|---|---|
| JP | H02-132056 | A | 5/1990 |
| JP | H05-017047 | A | 1/1993 |
| JP | H08-166746 | A | 6/1996 |
| JP | H10-035981 | A | 2/1998 |
| JP | 2000-118790 | A | 4/2000 |
| JP | 2000-191244 | A | 7/2000 |
| JP | 2002-326749 | A | 11/2002 |
| JP | 2004-212466 | A | 7/2004 |
| JP | 2004-219680 | A | 8/2004 |
| JP | 2005-055817 | A | 3/2005 |

OTHER PUBLICATIONS

Japan Patent Office, Notification of Reason for Refusal for Japanese Patent Application No. 2008-244500 (counterpart to above-captioned patent application), dispatched Sep. 28, 2010.

* cited by examiner

*Primary Examiner* — Judy Nguyen
*Assistant Examiner* — Blake A Tankersley
(74) *Attorney, Agent, or Firm* — Baker Botts L.L.P.

(57) ABSTRACT

An image forming apparatus includes: an image forming unit; a first sheet discharging path that reverses a traveling direction of a sheet and discharges the sheet; a cover, which forms a part of the first sheet discharging path when the cover is in a closed state; a second sheet discharging path, which is formed when the cover is in an open state, which is branched from the first sheet discharging path, and which discharges the sheet from the image forming unit without reversing the traveling direction of the sheet; a sensor, which is positioned downstream in a conveying direction of the sheet from the image forming unit, and which detects a passage of the sheet; and a determination unit that determines a jam based on a detection result of the sensor, the determination unit changing a determination criterion of the jam in accordance with the state of the cover.

5 Claims, 14 Drawing Sheets

FIG. 16

41

OCCURRENCE OF SHEET REMAINING UNDELIVERED

SHEET REMAINS UNDELIVERED IN THE APPARATUS.
THERE IS A POSSIBILITY THAT SHEET OF SIZE THAT CANNOT BE DISCHARGED TO THE SHEET DISCHARGE TRAY MAY BE CONVEYED.

PLEASE OPEN THE REAR COVER.

IMAGE FORMING APPARATUS WHICH CHANGES JAM DETERMINATION CRITERION

This application claims priority from Japanese Patent Application No. 2008-244500 filed on Sep. 24, 2008, the entire subject matter of which is incorporated herein by reference.

TECHNICAL FIELD

The invention relates to an image forming apparatus including a sheet discharging path for reversing a traveling direction of a sheet and discharging the sheet and a sheet discharging path for discharging a sheet without reversing the traveling direction thereof. More particularly, the invention relates to an image forming apparatus wherein a sheet discharging path for discharging a sheet without reversing the traveling direction thereof is formed by opening a cover.

BACKGROUND

A known image forming apparatus forms a sheet discharging path shaped like a U-turn (i.e., U-turn path) for reversing the traveling direction of a sheet and discharging the sheet. As the known image forming apparatus including the U-turn path, a printer has been proposed. In the printer, a cover for covering an outside of the U-turn path is provided in an openable and closeable manner, and a straight sheet discharging path (i.e., straight path) for discharging the sheet without reversing the traveling direction thereof can be formed by opening the cover.

The printer as the known image forming apparatus enables a user to use one of the sheet discharging paths selectively. For example, the printer switches the sheet discharging path to the U-turn path for face down printing or to the straight path for forming an image onto a firm sheet such as a cardboard.

SUMMARY

Illustrative aspects of the invention provide an image forming apparatus for enabling appropriate detection of a jam while reducing a size of the image forming apparatus.

BRIEF DESCRIPTION OF THE DRAWINGS

Illustrative aspects of the invention will be described in detail with reference to the following figures wherein:

FIG. 16 shows additional example of the display unit indicating that the sheet remains undelivered.

DETAILED DESCRIPTION

<General Overview>

Figure 1:
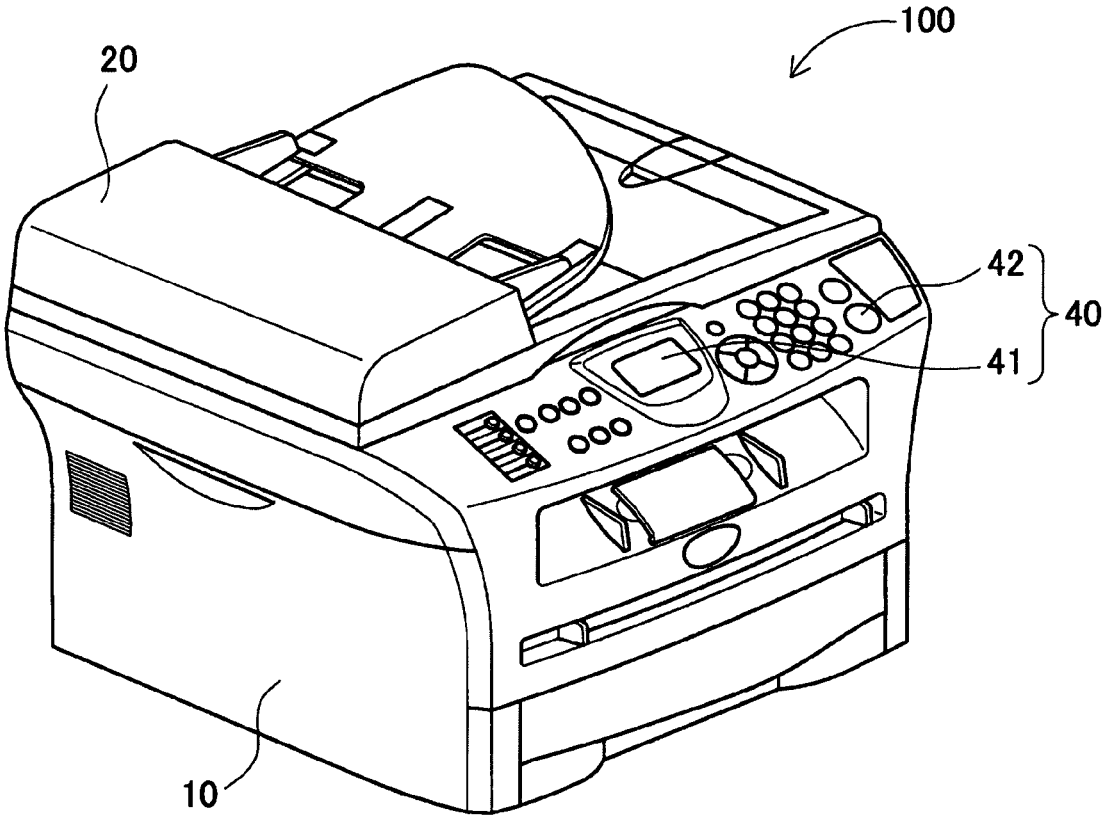
FIG. 1 is a schematic perspective view of an image forming apparatus according to an exemplary embodiment of the invention.

In the known image forming apparatus described above, the behavior of a sheet may change with the open or closed state of the cover depending on the placement of a sensor, and a jam may be erroneously determined.

For example, in order to reduce a size of an image forming apparatus, a sheet discharging path of the image forming apparatus is likely to be formed with a curve portion such as a U-turn path. In such a configuration, the sheet discharging path may be formed such that a branch point of the U-turn path and a straight path is positioned in the curve portion. Further, a sensor used to detect a jam may be placed in a position just after the branch point. In order to use the straight path (namely, when the cover is open) in the image forming apparatus, when the leading end of the sheet enters the sensor, the sheet can be detected as the sheet moves upward. However, as discharging the sheet advances, the sheet hangs down under its own weight. Thus, it may become difficult to detect the sheet. Thus, it becomes difficult for the sensor to precisely determine passage of the sheet. In contrast, in order to stabilize the behavior of a sheet, is considered that the sheet discharging path may be lengthened. However, the size of the apparatus may be enlarged.

Therefore, illustrative aspects of the invention provide an image forming apparatus for enabling appropriate detection of a jam while reducing a size of the apparatus.

According to a first illustrative aspect of the invention, there is provided an image forming apparatus comprising: an image forming unit that forms an image on a sheet; a first sheet discharging path that reverses a traveling direction of the sheet passed through the image forming unit so as to discharge the sheet; a cover, which is openable and closable with respect to the image forming unit, and which forms a part of the first sheet discharging path when the cover is in a closed state; a second sheet discharging path, which is formed when the cover is in an open state, which is branched from the first sheet discharging path, and which discharges the sheet passed through the image forming unit without reversing the traveling direction of the sheet; a sensor, which is positioned downstream in a conveying direction of the sheet from the image forming unit, and which detects a passage of the sheet; and a determination unit that determines a jam based on a detection result of the sensor, the determination unit changing a determination criterion of the jam in accordance with the open or closed state of the cover.

In the image forming apparatus according to the first illustrative aspect of the invention, the first sheet discharging path for reversing the traveling direction of a sheet and discharging the sheet and the second sheet discharging path for discharging the sheet without reversing the traveling direction are provided downstream from the image forming unit. The second sheet discharging path branches from the first sheet discharging path and is provided by opening the cover for closing a part of the first sheet discharging path. The image forming unit includes an image forming unit for forming an image. In addition, if the image forming apparatus is an electrophotographic image forming apparatus, the image forming unit thereof may also include a fixing unit for fixing the image onto a sheet. The image forming apparatus includes the sensor downstream from the image forming unit for detecting the passage of the sheet in order to determine a jam based on the output result from the sensor. Determination criterion of the jam at the open time of the cover and determination criterion of the jam at the closing time of the cover differ.

That is, in the image forming apparatus according to the invention, the determination criterion of the jam can be changed in accordance with the open or closed state of the cover, so that the determination criterion of jam can be adopted in accordance with change of behavior of the sheet accompanying the open or closed state of the cover. Thus, determination error of the jam can be suppressed. Since the determination criterion of the jam can be changed, substance of the determination criterion may be designed appropriately according to placement of the sensor, and flexibility of the placement of the sensor can be enhanced. Further, it is not necessary to extend the sheet discharging path or to increase the number of sensors for avoiding a determination error. As a result, the size of the image forming apparatus can be reduced.

According to a second illustrative aspect of the invention, in the image forming apparatus, wherein the determination unit relaxes the determination criterion of the jam when the cover is in the open state as compared with the determination criterion when the cover is in the closed state.

The sheet behavior becomes sometimes unstable when the cover is opened. For example, when the cover is opened, a sheet is discharged on the second sheet discharging path. Even if the sheet entering timing can be detected, the later continuous detection may become unstable. Thus, the reliability of jam determination at the cover open time is low as compared with that at the cover closing time. Then, preferably the determination criterion at the open time of the cover is relaxed. For example, according to a third illustrative aspect of the invention, the determination unit relaxes the determination criterion of the jam by canceling the determination of the jam when the sensor has continuously detected the sheet for a predetermined time period. Accordingly, the determination error of the jam can be suppressed.

According to a fourth illustrative aspect of the invention, in the image forming apparatus, wherein the sensor is provided at a position, in which the sensor can detect a leading end of the sheet when the cover is in the open state, and in which the sensor cannot detect the sheet in accordance with a change in the behavior of the sheet after detecting the leading end of the sheet.

As the place satisfying the above-mentioned condition, for example, if the branch point of the first sheet discharging path and the second sheet discharging path is set to a position before traveling direction inversion, of a curve portion in the first sheet discharging path, a position just after the branch point is applied.

According to a fifth illustrative aspect of the invention, the image forming apparatus further comprises: a fixing unit; and a second sensor, which is provided in a position between the fixing unit and a branch point of the first sheet discharging path and the second sheet discharging path in the sheet conveying direction, and which detects the passage of the sheet.

That is, the path upstream from the branch point of the first sheet discharging path and the second sheet discharging path is not affected by opening or closing the cover. By providing the second sensor at such a position, a jam in the fixing unit can be detected.

According to a sixth illustrative aspect of the invention, the image forming apparatus further comprises: a sheet length determination unit that determines whether a length of the sheet is less than a minimum sheet length that can be conveyed on the first sheet discharging path when the cover is in the closed state; and a stop unit that stops subsequent sheet conveying if the sheet length determination unit determines that the length of the sheet is less than the minimum sheet length.

That is, if a sheet having a length less than the minimum sheet length for the image forming apparatus is conveyed, the sheet may remain undelivered in the first sheet discharging path. Then, if such a sheet is determined to be conveyed, conveyance of the subsequent sheets is stopped. Accordingly, a jam associated with the sheet remaining undelivered can be prevented.

According to a seventh illustrative aspect of the invention, the image forming apparatus further comprises: a notification unit that indicates that the sheet remains undelivered in the first sheet discharging path if the sheet length determination unit determines that the length of the sheet is less than the minimum sheet length.

That is, by indicating that a sheet having a length less than the minimum sheet length is carried in the apparatus, the user can recognize that the sheet remains undelivered. Further, such an indication may encourage the user to remove the sheet, so that conveyance of the sheet will be early restarted.

According to an eighth aspect of the invention, there is provided an image forming apparatus comprising: an image forming unit that forms an image on a sheet; a fixing unit that fixes the image formed on the sheet to the sheet; a sheet tray that is configured to receive the sheet passed through the fixing unit; a sheet discharging path, which guides the sheet from the fixing unit to the sheet tray, and which includes an opening between the fixing unit and the sheet tray; a door, which is provided at the opening of the sheet discharging path, and which opens and closes the opening; a first sensor, which is provided between the fixing unit and the sheet tray, and which detects a passage of the sheet, the first sensor sending a first signal indicating detection result of the passage of the sheet; a second sensor, which detects a state of the door, and which sends a second signal indicating whether the door is in a opened state or in a closed state; and a determination unit that receives the signals from the first sensor and the second sensor, wherein when the determination unit receives the second signal indicating that the cover is in the closed state, the determination unit executes a jam determination process as to determine whether a jam is occurred or not based on the first signal, and wherein when determination unit receives the second signal indicating that the cover is in the opened state, the determination unit does not execute the jam determination process.

According to a ninth aspect of the invention, in the image forming apparatus, wherein when the determination unit receives the second signal indicating that the cover is in the closed state, the determination unit determines whether a time period, during which the first sensor detects the passage of the sheet, indicated in the first signal exceeds a predetermined time period or not, wherein the determination unit determines that the jam is occurred if the time period indicated in the first signal exceeds the predetermined time period, and wherein the determination unit determines that a jam is not occurred if the time period indicated in the first signal does not exceed the predetermined time period.

According to the illustrative aspects of invention, the image forming apparatus can implement appropriate detection of the paper jam while reducing the size of the image forming apparatus.

Exemplary Embodiments

Exemplary embodiments of the invention will now be described with reference to the drawings.

(Image Forming Apparatus)

As shown in FIG. 1, an image forming apparatus 100 includes a main unit 10 for printing an image on a sheet and an image read unit 20 for reading an image of a document. An electrophotographic color printer, which includes a sheet discharging path for reversing the traveling direction of a sheet and discharging the sheet and a sheet discharging path for discharging the sheet without reversing the traveling direction thereof, is one example of the image forming apparatus 100. The image forming apparatus 100 further includes, on a front side of the image reading unit 20, an operation panel 40 including a display unit 41 made of a liquid crystal display and a button group 42 includes a start key, a stop key, a numeric keypad, etc. The operational panel 40 can display an operation state of the image forming apparatus. Further, a user can perform input operation through the operation panel 40.

(Main Unit)

Figure 2:
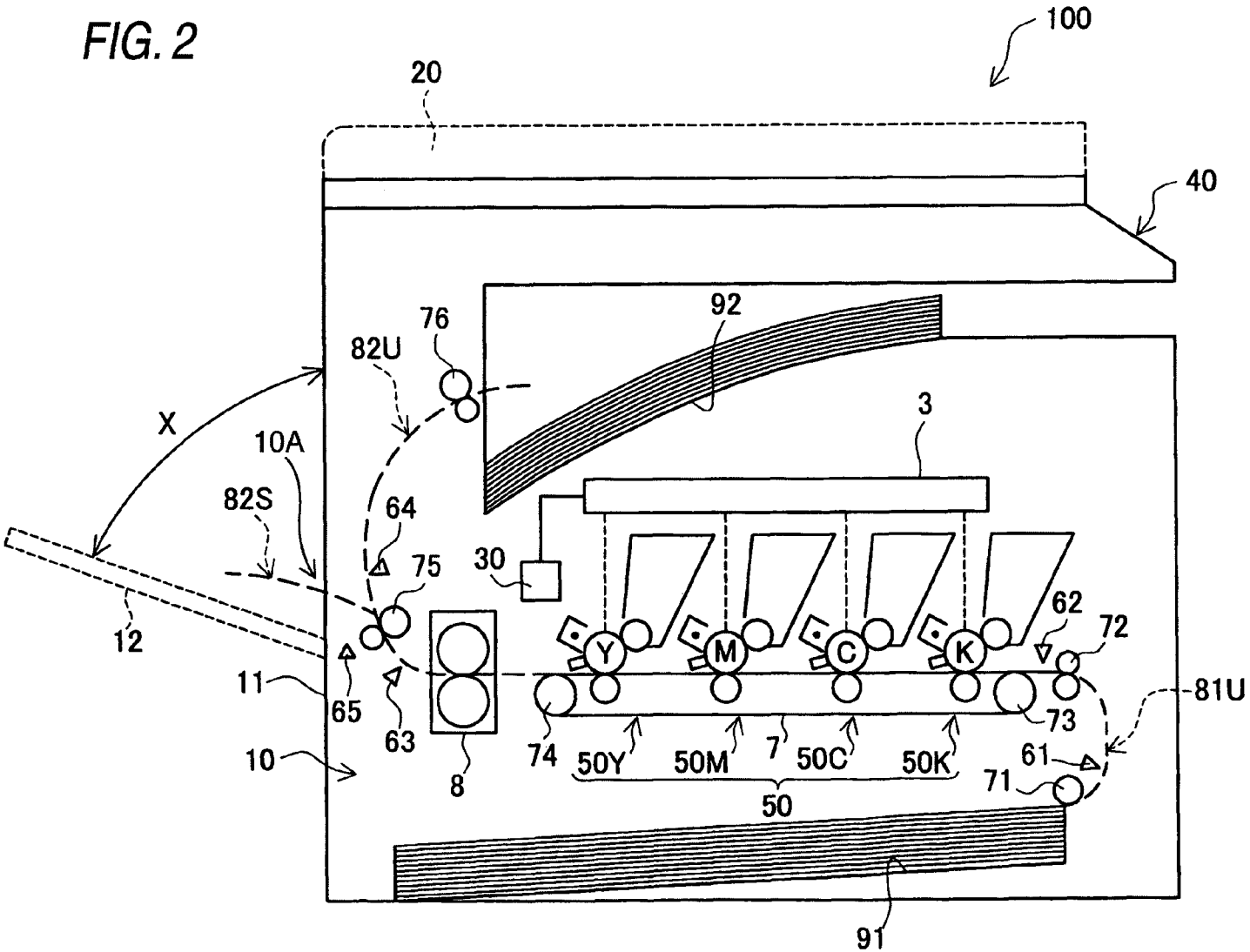
FIG. 2 is a schematic view of a main unit of the image forming apparatus.

As shown in FIG. 2, the main unit 10 includes a process unit 50 (one example of an image forming unit), a fixing unit 8 (one example of the image forming unit), an opening 10A, a sheet feed cassette 91, a sheet discharge tray 92, an exposure unit 3 and a belt 7. The process unit 50 forms a developer image and transfers the developer image to a sheet. The fixing unit 8 fixes an unfixed developer image on the sheet. The sheet feed cassette 91 accommodates a sheet before image formation. The sheet discharge tray 92 places a sheet after the image formation thereon. A cover 12 (one example of a door) is provided on a back face of a housing 11 that houses the main unit 10. In other words, the cover 12 is provided at the opening 10A. The cover 12 rotates in a direction indicated by an arrow X in FIG. 2 so as to be openable and closable with respect to the housing 11.

The process unit 50 of the main unit 10 forms a color image. Process units corresponding to colors of yellow (Y), magenta (M), cyan (C), and black (K) are placed in parallel. The process unit 50 includes a process unit 50Y, 50M, 50C and 50K for forming to four colors (e.g., yellow, magenta, cyan and black). The exposure unit 3 emits light to the process units 50Y, 50M, 50C, and 50K. The belt 7 is stretched between rollers 73 and 74 so as to convey the sheet to transfer positions of the process units 50Y, 50M, 50C, and 50K.

Figure 3:
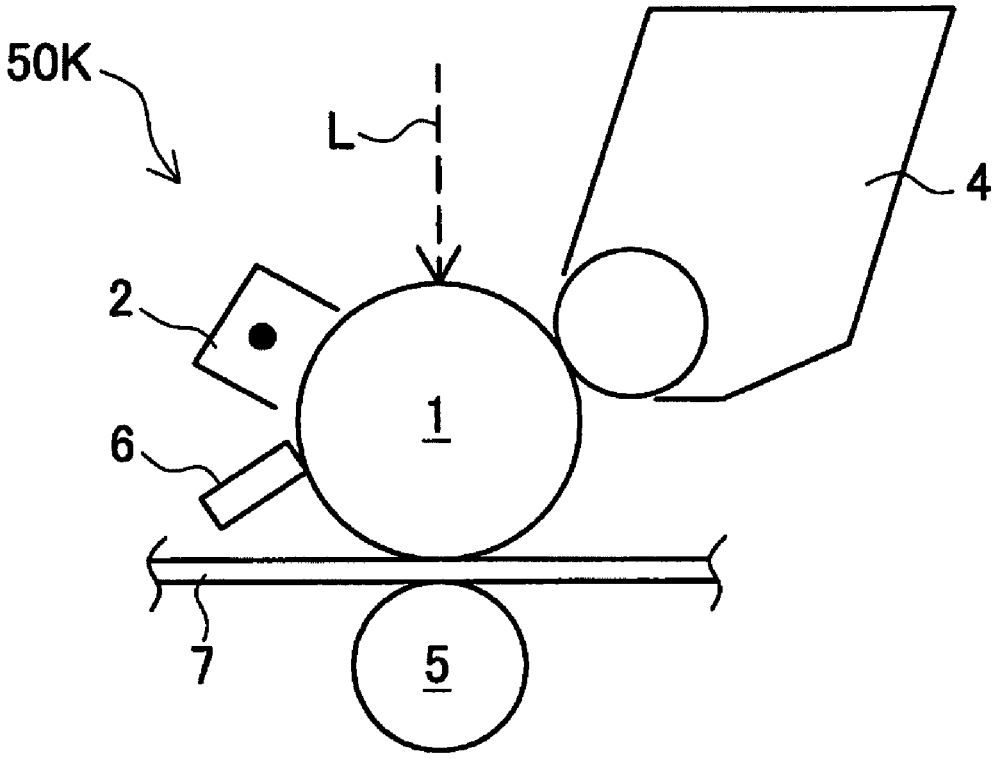
FIG. 3 is a schematic view of a process unit of the image forming apparatus.

The process unit 50K forms the developer image electrophotographically. As shown in FIG. 3, the process unit 50K includes a photosensitive drum 1, a charging unit 2 that uniformly charges a surface of the photosensitive drum 1, a developing unit 4 for developing an electrostatic latent image with developer, a transfer unit 5 for transferring the developer image on the photosensitive drum 1 to the sheet, and a cleaning blade 6 for removing the developer remained on the photosensitive drum 1. Incidentally, toner is one example of the developer. The photosensitive drum 1, the charging unit 2, the developing unit 4, and the cleaning blade 6 are formed as a process cartridge. The process cartridge is removably mounted to the main unit 10. Each of other process units 50Y, 50M, and 50C has a similar configuration to that of the process unit 50K.

In the process unit 50K, the surface of the photosensitive drum 1 is uniformly charged by the charging unit 2. Then, the photosensitive drum 1 is exposed to light L emitted from the exposure unit 3 to form an electrostatic latent image. Next, the developer is supplied to the photosensitive drum 1 through the developing unit 4. Accordingly, the electrostatic latent image on the photosensitive drum 1 is visualized as the developer image. The developer image is transferred to the sheet conveyed by the belt 7 at a position opposed to the transfer unit 5.

In the main unit 10, a sheet stored in the sheet feed cassette 91 positioned at the bottom is conveyed along a sheet feeding path 81U having a substantially U-shape, passes through a feed roller 71 and a registration roller 72, reverses a traveling direction thereof, and is introduced into the process unit 50. That is, in the main unit 10, sheets in the sheet feed cassette 91 are fed one at a time and the fed sheet is conveyed to the process unit 50 and the developer image is transferred to the sheet. Then, the sheet is conveyed to the fixing unit 8, and the developer image is thermally fixed on the sheet.

The main unit 10 includes two sheet discharging paths downstream in the sheet conveying direction from the fixing unit 8. One is a sheet discharging path 82U having a substantially U-shape (one example of a first sheet discharging path) (hereinafter referred to as "U-turn path 82U"), in which the path passes through a conveying roller 75 and a discharge roller 76, reverses the traveling direction, and is introduced into the sheet discharge tray 92. In the image forming apparatus 100, inner side face of the cover 12 forms a part of the U-turn path 82U. Therefore, a sheet can be passed through the U-turn path 82U when the cover 12 is closed. The other is a sheet discharging path 82S having a substantially liner shape (one example of second sheet discharging path) (hereinafter referred to as "straight path 82S"), in which the path passes through the conveying roller 75, does not to reverse the traveling direction, and is introduced into the opened cover 12 through the opening 10A when the cover 12 is opened. In the straight path 82S, the cover 12 also functions as a sheet discharge tray. The sheet can be passed through the straight path 82S when the cover 12 is open.

That is, in the image forming apparatus 100 according to the exemplary embodiment, the U-turn path 82U is selected when the cover 12 is closed, and the straight path 82S is selected when the cover 12 is open. In the main unit 10, the sheet, on which the developer image is fixed, is discharged via either of the sheet discharging paths to outside of the main unit 10.

A plurality of sensors for detecting the passage of a sheet is placed in the main unit 10. That is, the image forming apparatus 100 includes: a sensor 61 (hereinafter referred to as "before-registration sensor 61") positioned just after the feed roller 71 in the conveying direction of a sheet; a sensor 62 (hereinafter referred to as "after-registration sensor 62") positioned downstream the registration roller 72 and upstream from the process unit 50; a sensor 63 (one example of a second sensor) (hereinafter referred to as "before-branch sensor 63") positioned downstream from the fixing unit 8 and upstream from a branch point of the U-turn path 82U and the straight path 82S (in the exemplary embodiment, the conveying roller 75); and a sensor 64 (one example of a sensor) (hereinafter referred to as "after-branch sensor 64") positioned downstream from the branch point and upstream from the discharge roller 76. The image forming apparatus 100 determines conveying timing of the sheet to the process unit 50 and detects a conveying failure of a jam, etc., based on a signal from each sensor.

The image forming apparatus 100 further includes a sensor 65 (hereinafter referred to as "cover sensor 65") for detecting the open/closed state of the cover 12. The image forming apparatus 100 determines the sheet discharging path based on a signal from the cover sensor 65. Incidentally, detailed configuration of each sensor will not be described here. A known device can be applied as each sensor.

In the sheet discharging paths, the minimum interval between rollers downstream from the conveying roller 75 and forming the U-turn path 82U is set to 150 mm, and the minimum interval between rollers forming the conveying path upstream from the conveying roller 75 is set to 100 mm, for example. Thus, the minimum sheet length of a sheet that can be conveyed on the U-turn path 82U is 150 mm and the minimum sheet length of a sheet that can be conveyed on the straight path 82S is 100 mm.

(Electric Configuration of Image Forming Apparatus)

Figure 4:
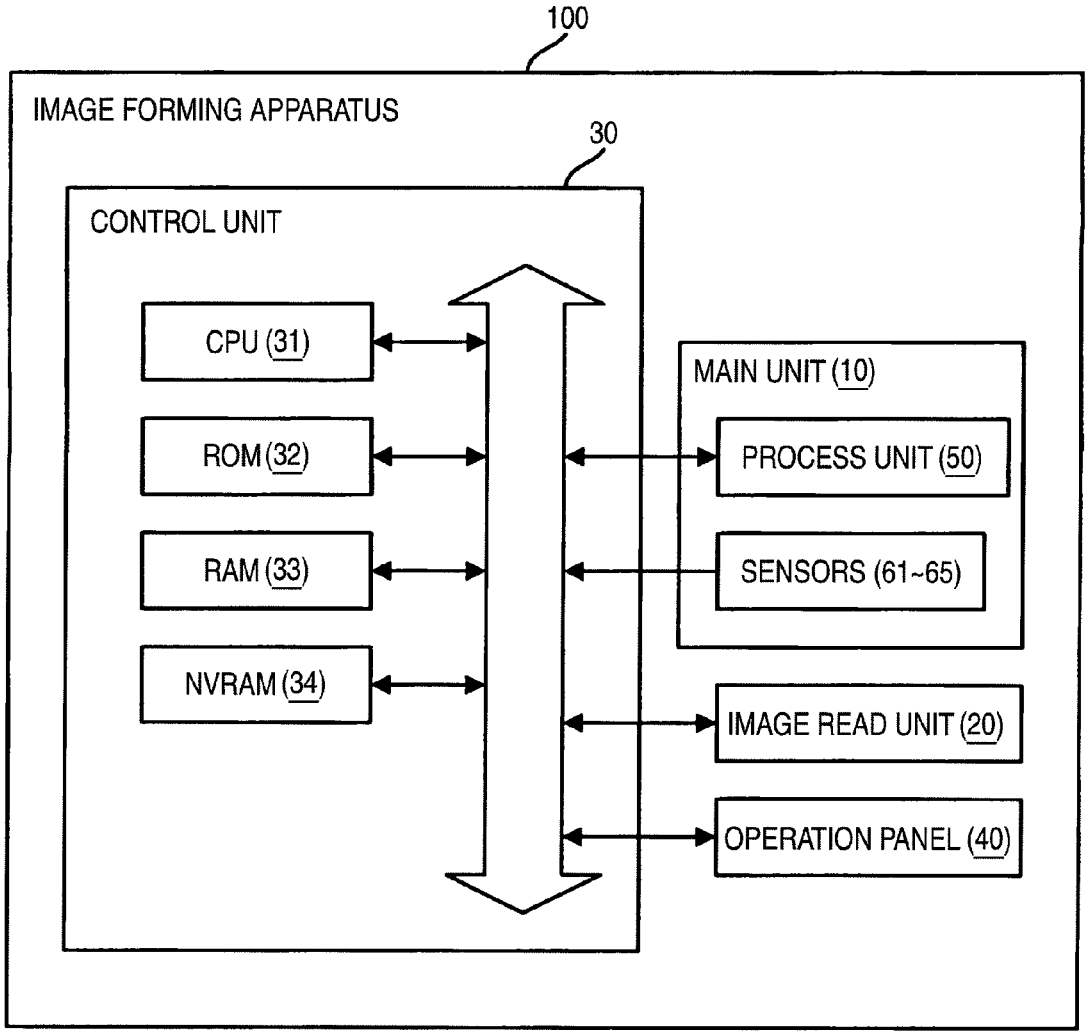
FIG. 4 is a block diagram showing electric configuration of the image forming apparatus.

An electric configuration of the image forming apparatus 100 will be described. As shown in FIG. 4, the image forming apparatus 100 includes a control unit 30 (one example of a determination unit, a sheet length determination unit and a stop unit) including a CPU 31, ROM 32, RAM 33, and NVRAM (nonvolatile RAM) 34. The control unit 30 is electrically connected to the main unit 10, the image read unit 20, the operation panel 40, etc.

The ROM 32 stores various control programs, various settings, initial values, etc., for controlling the image forming apparatus 100. The RAM 33 is used as a work area, into which the control programs are read, or a storage area for temporarily storing image data.

The CPU 31 controls components of the image forming apparatus 100 (for example, the lighting timing of the exposure unit 3, drive motors (not shown) of the rollers forming the sheet feeding path 81U and the sheet discharging paths 82U and 82S, and a moving motor (not shown) of an image sensor unit implementing the image read unit 20) while storing processing result thereof in the RAM 33 or the NVRAM 34 in accordance with the control program read from the ROM 32 and the signals sent from the various sensors.

(Jam Detection Process)

Subsequently, a jam detection process will be described. A jam is detected based on the timing at which a sheet reaches each sensor (i.e., detection timing of the leading end of the sheet) and the timing at which a sheet passes through each sensor (i.e., detection timing of the trailing end of the sheet).

Figure 5:
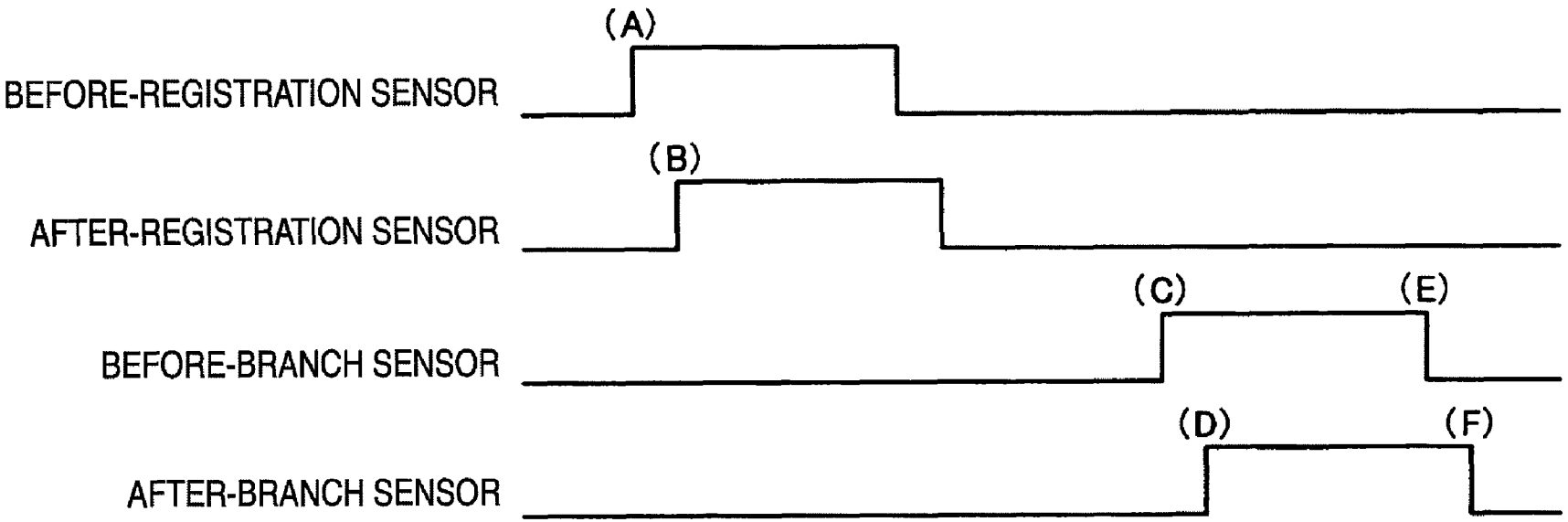
FIG. 5 is a timing chart showing an output operation flow of sensors.

Specifically, a jam is determined based on the output signal of each sensor. FIG. 5 shows an example of the output signals of the sensors when a sheet is normally conveyed on the sheet discharging path 82U. First, when a sheet is delivered from the sheet feed cassette 91, initially the before-registration sensor 61 detects arrival of the sheet (A) and outputs high (ON). Then, when the leading end of the sheet passes through the registration roller 72, the after-registration sensor 62 detects the sheet and is turned ON (B). Then, the sheet is conveyed to the process unit 50 and the trailing end of the sheet passes through the before-registration sensor 61, whereby the before-registration sensor 61 outputs low (OFF). The trailing end of the sheet passes through the after-registration sensor 62, the after-registration sensor 62 is turned OFF.

As the leading end of the sheet passes through the process unit 50 and the fixing unit 8, the before-branch sensor 63 detects arrival of the sheet (C) and is turned ON. Then, when the leading end of the sheet passes through the conveying roller 75, the after-branch sensor 64 detects arrival of the sheet (D) and is turned ON. Then, the sheet is delivered from the trailing end from the fixing unit 8 and the trailing end of the sheet passes through the before-branch sensor 63, whereby the before-branch sensor 63 is turned OFF (E). The trailing end of the sheet passes through the after-branch sensor 64, the after-branch sensor 64 is turned OFF (F).

Under such operation, for example, if the before-branch sensor 63 is not turned ON within a predetermined time since the after-registration sensor 62 was turned ON (B), it is determined that a jam occurs between the after-registration sensor 62 and the before-branch sensor 63. For example, if the before-branch sensor 63 is not turned OFF within a predetermined time since the before-branch sensor 63 was turned ON (C), it is determined that the jam occurs in the fixing unit 8.

(Sheet Leading End Jam Detection Process)

Figure 6:
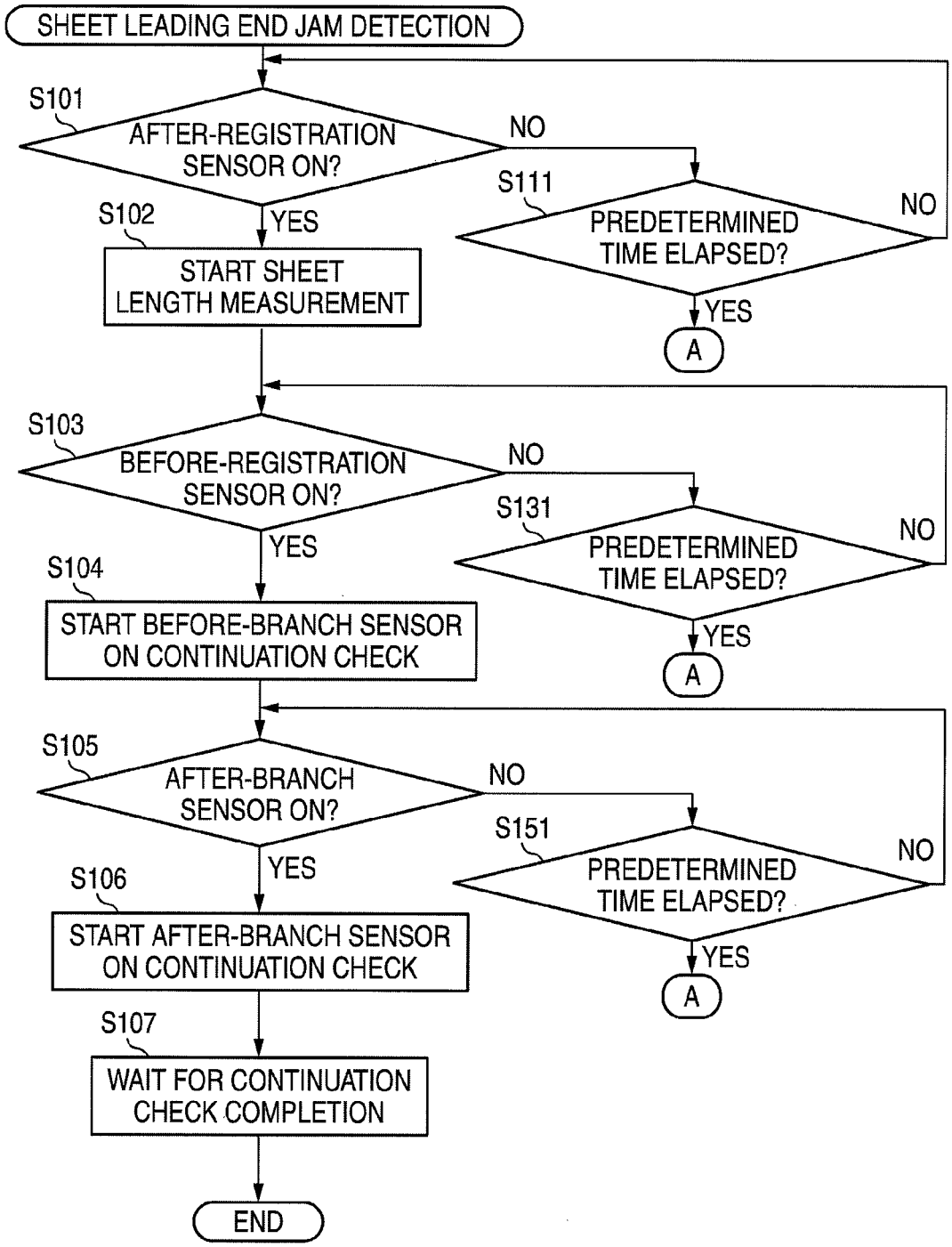
FIG. 6 is a flowchart showing a jam detection process of a leading end of a sheet.

A jam detection process will be described below. Jam detection process when the leading end of a sheet is detected (one example of a determination unit) will be described with reference to a flowchart of FIG. 6. This process is started when the before-registration sensor 61 being turned ON is detected.

First, it is determined whether the after-registration sensor 62 is turned ON (S101). If the after-registration sensor 62 is not turned ON (NO at S101), it is determined whether the count time since the point in time at which the before-registration sensor 61 was turned ON ((A) in FIG. 5) exceeds a predetermined time (S111). That is, it is determined whether the move time of the leading end of the sheet from the before-registration sensor 61 to the after-registration sensor 62 (between (A) and (B) in FIG. 5) is within an allowable range. If the count time does not exceed the predetermined time (NO at S111), the process returns to S101.

Figure 7:
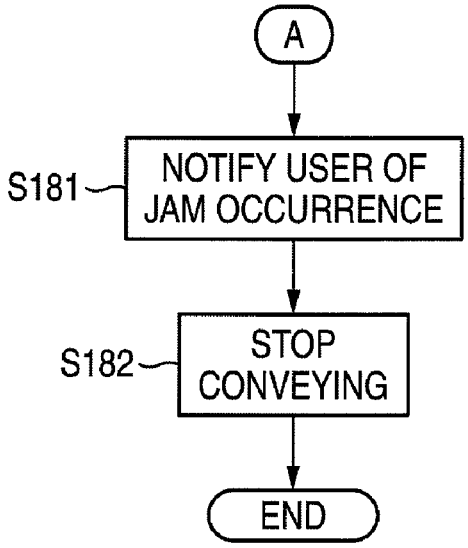
FIG. 7 is a flowchart showing a jam stop process.

In contrast, if the count time exceeds the predetermined time (YES at S111), it can be determined that a jam occurs between the before-registration sensor 61 and the after-registration sensor 62. Then, the routine makes a transition to a flowchart of FIG. 7 and a jam stop process (one example of a stop unit) is performed.

Figure 8:
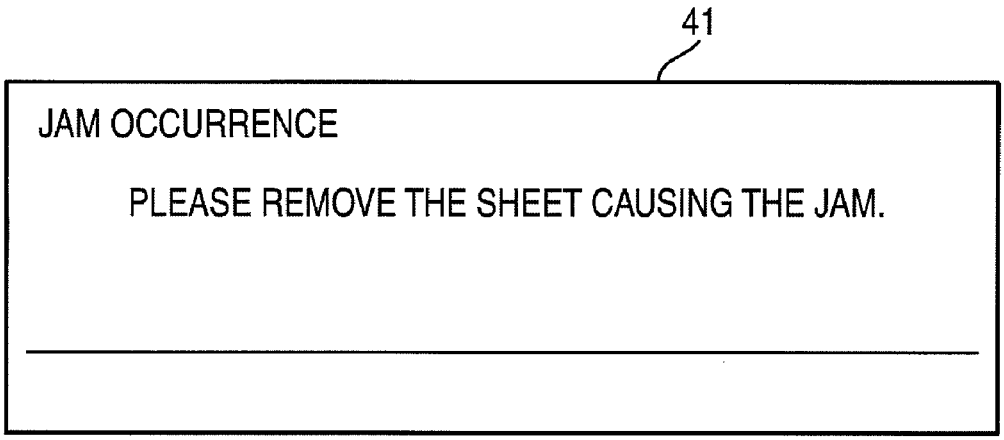
FIG. 8 shows an example of a display unit indicating an occurrence of a jam.

In the jam stop process, first the user is notified that a jam has occurred (S181). In the exemplary embodiment, a message as shown in FIG. 8 is displayed on the display unit 41 of the image forming apparatus 100. This message display enables the user to recognize the jam. In addition to the message display, a voice message, a warning beep, etc., may be produced. The sheet conveying operation is stopped (S182). The order of S181 and S182 may be reversed.

Figure 9:
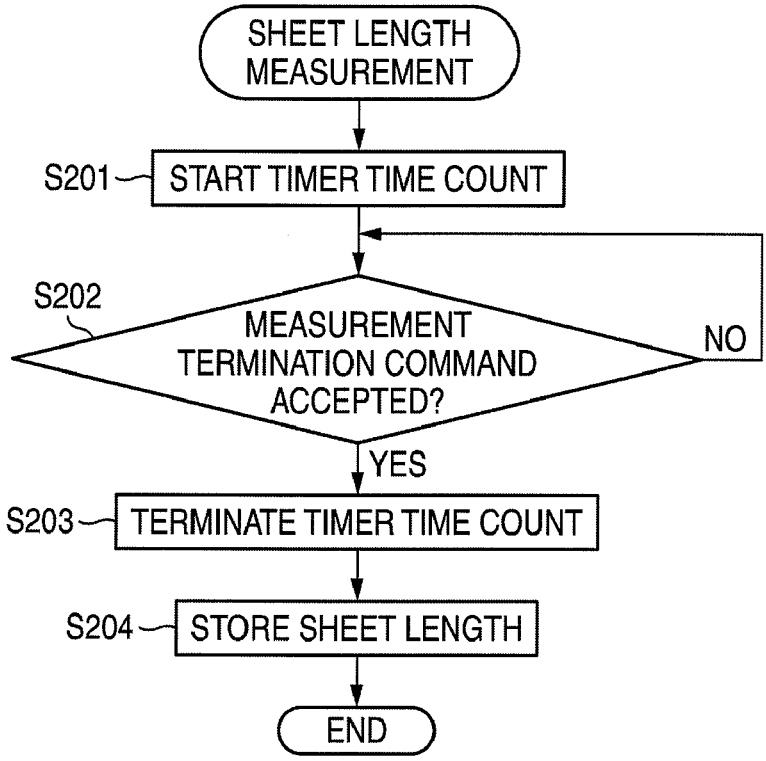
FIG. 9 is a flowchart showing a sheet length measurement process.

Referring again to FIG. 6, if the after-registration sensor 62 is turned ON within a predetermined time (YES at S101), sheet length measurement is started (S102). The sheet length is measured according to a process shown in a flowchart of FIG. 9.

First, time count of a timer is started (S201). The image forming apparatus 100 waits until a measurement termination command (described later) is accepted (S202). This means that the time count of the timer is continued until a measurement termination command is accepted. If a measurement termination command is accepted (YES at S202), the time count of the timer is terminated (S203). The count time can be converted into the sheet length. Then, the count time or the sheet length found from the count time is stored (S204) and the sheet length measurement process is terminated.

Referring again to FIG. 6, after the sheet length measurement is started, it is determined whether the before-branch sensor 63 is turned ON (S103). If the before-branch sensor 63 is not turned ON (NO at S103), it is determined whether the count time since the point in time at which the after-registration sensor 62 was turned ON (FIG. 5 (B)) exceeds a predetermined time (S131). That is, it is determined whether the move time of the leading end of the sheet from the after-registration sensor 62 to the before-branch sensor 63 (between (B) and (C) in FIG. 5) is within an allowable range. If the count time does not exceed the predetermined time (NO at S131), the process returns to S103.

In contrast, if the count time exceeds the predetermined time (YES at S131), it can be determined that a jam occurs between the after-registration sensor 62 and the before-branch sensor 63. Then, the routine makes a transition to the flowchart of FIG. 7 and the jam stop process is performed.

If the before-branch sensor 63 is turned ON within a predetermined time (YES at S103), ON continuation check process of the before-branch sensor 63 is started (S104). Even after the leading end of the sheet passes through the before-branch sensor 63, the before-branch sensor 63 may be again turned OFF immediately as the jam occurs in the fixing unit 8. The ON continuation check of the before-branch sensor 63 is checked, whereby occurrence of the jam in the fixing unit 8 is determined.

Figure 10:
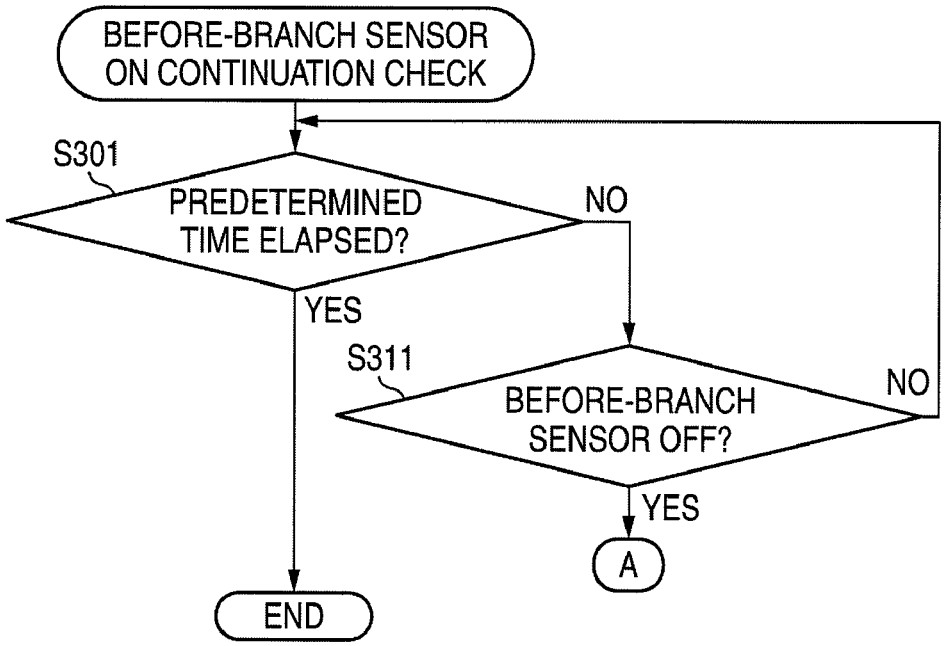
FIG. 10 is a flowchart showing an ON continuation check process of a before-branch sensor.

Specifically, the ON continuation check process of the before-branch sensor 63 is performed according to a process shown in a flowchart of FIG. 10. First, it is determined whether the count time since the point in time at which the before-branch sensor 63 was turned ON ((C) in FIG. 5) exceeds a predetermined time (S301). If the count time does not exceed the predetermined time (NO at S301), it is determined whether the before-branch sensor 63 is turned OFF (S311). If the before-branch sensor 63 is not turned OFF (NO at S311), the process returns to S301.

In contrast, if the before-branch sensor 63 is turned OFF before the expiration of a predetermined time (YES at S311), it can be determined that reverse (backward) inclusion into the fixing unit 8 occurs. Then, the routine makes a transition to the flowchart of FIG. 7 and the jam stop process is performed. When the predetermined time has elapsed although the before-branch sensor 63 is not turned OFF (YES at S301), the ON continuation check process is terminated.

Referring again to FIG. 6, after the ON continuation check process of the before-branch sensor 63 is started, it is determined whether the after-branch sensor 64 is turned ON (S105). If the after-branch sensor 64 is not turned ON (NO at S105), it is determined whether the count time since the point in time at which the before-branch sensor 63 was turned ON ((C) in FIG. 5) exceeds a predetermined time (S151). That is, it is determined whether the move time of the leading end of the sheet from the before-branch sensor 63 to the after-branch sensor 64 (between (C) and (D) in FIG. 5) is within an allowable range. If the count time does not exceed the predetermined time (NO at S151), the process returns to S105.

In contrast, if the count time exceeds the predetermined time (YES at S151), it can be determined that a jam occurs between the before-branch sensor 63 and the after-branch sensor 64. Then, the routine makes a transition to the flowchart of FIG. 7 and the jam stop process is performed.

If the after-branch sensor 64 is turned ON within a predetermined time (YES at S105), ON continuation check process of the after-branch sensor 64 is started (S106). That is, as with the before-branch sensor 63, even after the leading end of the sheet passes through the after-branch sensor 64, the after-branch sensor 64 may be again turned OFF immediately as reverse (backward) inclusion into the fixing unit 8 occurs. The ON continuation check of the after-branch sensor 64 is checked, whereby reverse (backward) inclusion into the fixing unit 8 is determined.

Figure 11:
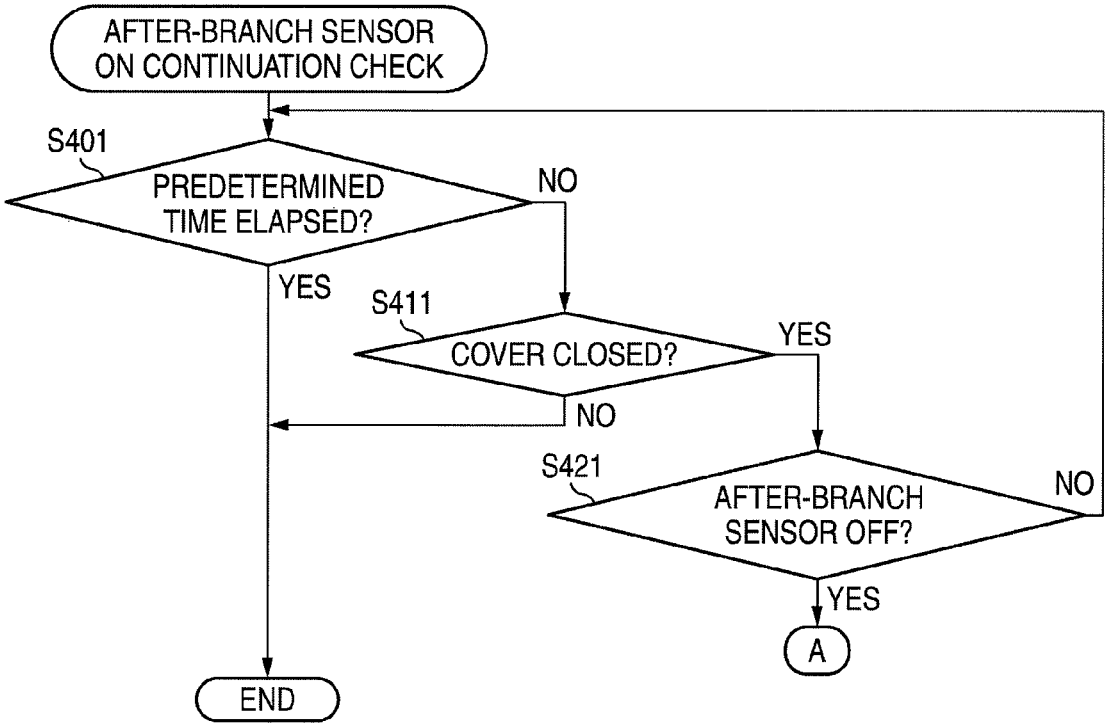
FIG. 11 is a flowchart showing an ON continuation check process of an after-branch sensor.

Specifically, the ON continuation check process of the after-branch sensor 64 is performed according to a process shown in a flowchart of FIG. 11. First, it is determined whether the count time since the point in time at which the after-branch sensor 64 was turned ON ((D) in FIG. 5) exceeds a predetermined time (S401). If the count time does not exceed the predetermined time (NO at S401), it is determined whether the cover 12 is closed (S411). The open or closed state of the cover 12 is determined based on the output signal of the cover sensor 65.

The reliability of the after-branch sensor 64 will be described. In the image forming apparatus 100, the conveying roller 75 becomes the branch point of the U-turn path 82U and the straight path 82S. As shown in FIG. 2, the conveying roller 75 is placed at a position in the first half of the curve portion of the U-turn path 82U (portion before the traveling direction is reversed), and the sheet discharging direction forms an angle of a predetermined value or more with respect to the horizontal plane. Thus, the sheet discharged from the conveying roller 75 is conveyed upward to some extent. The after-branch sensor 64 is placed downstream from the branch point (in the exemplary embodiment, the conveying roller 75) in the curve portion of the U-turn path 82U. In the configuration, the behavior of the sheet conveyed from the conveying roller 75 is as follows.

Figure 12:
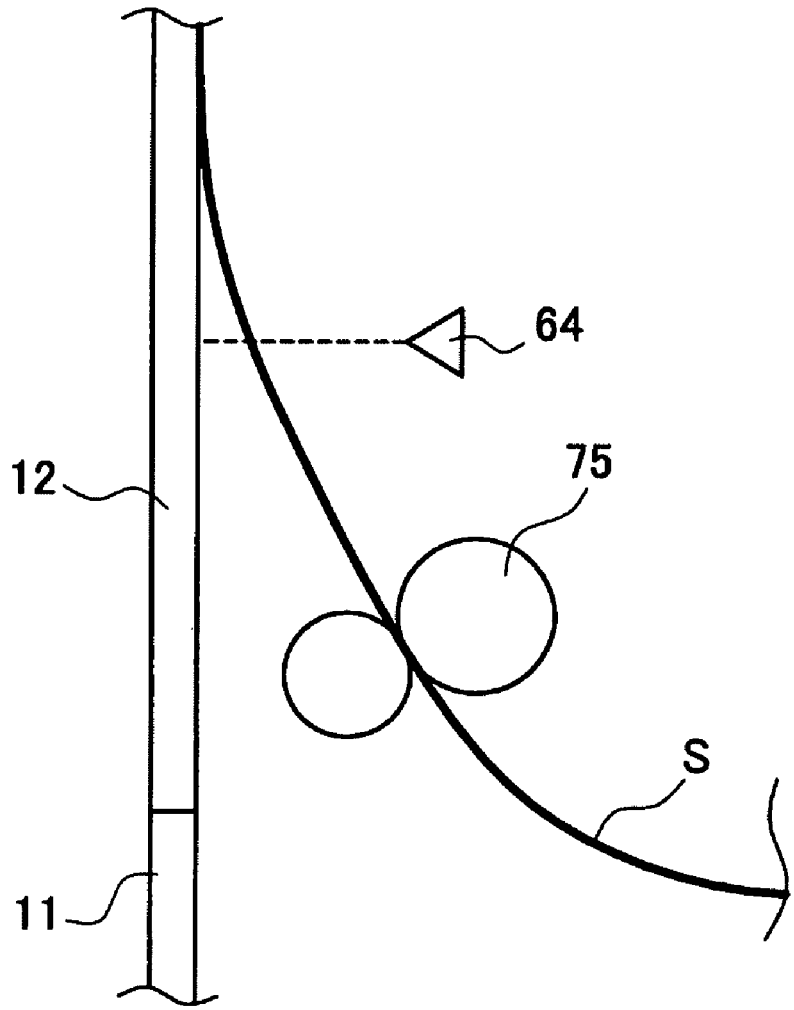
FIG. 12 is a schematic drawing showing a periphery of the after-branch sensor, in which a cover is in a closed state.

First, when the U-turn path 82U is selected, a sheet S is conveyed upward along the U-turn path 82U, as shown in FIG. 12. Further, the cover 12 forms a part of the U-turn path 82U. Thus, the sheet S is conveyed upward while it is guided on the inner side face of the cover 12. Therefore, the behavior of the sheet is stable and the after-branch sensor 64 can stably detect the leading end to the trailing end of the sheet.

Figure 13:
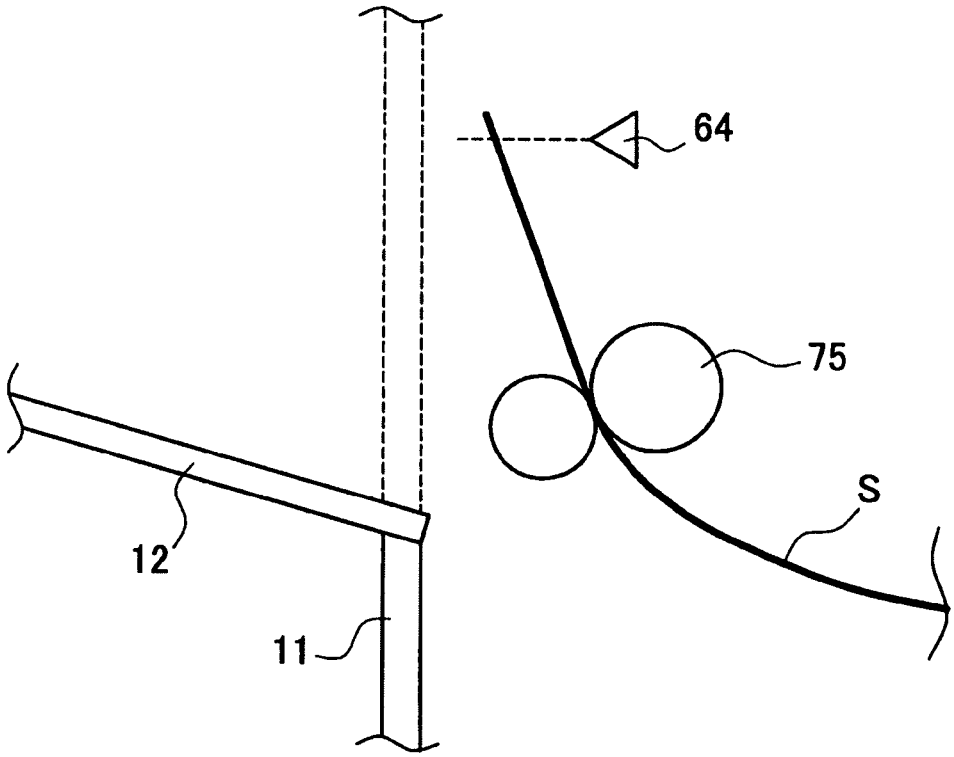
FIG. 13 is additional schematic drawing showing the periphery of the after-branch sensor, in which the cover is in an open state and at an initial time of sheet conveying.
Figure 14:
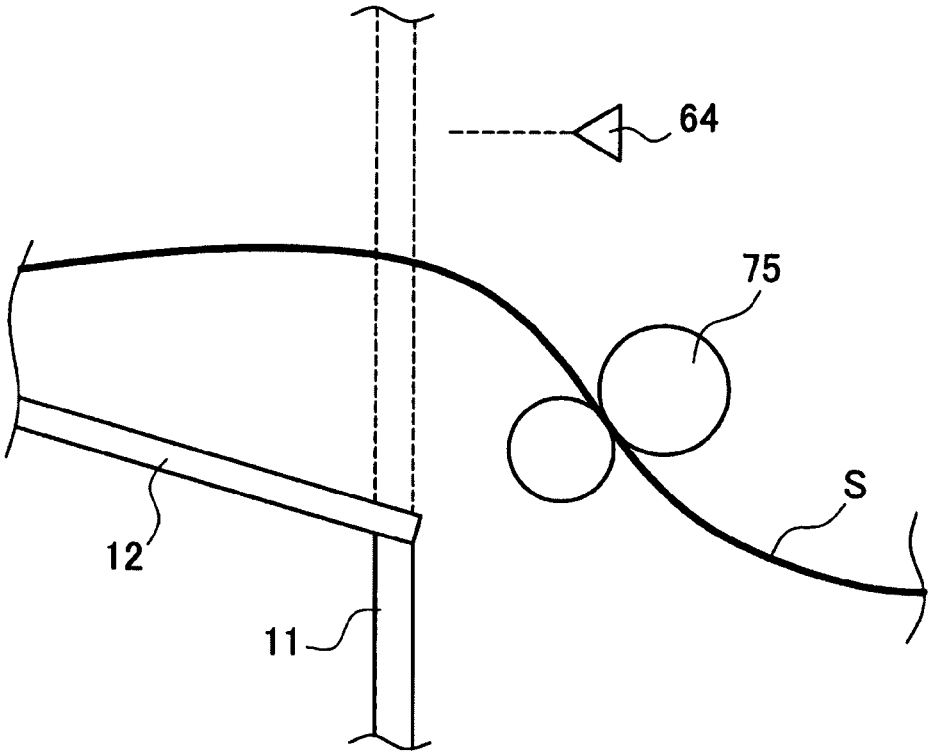
FIG. 14 is a still another schematic drawing showing the periphery of the after-branch sensor, in which the cover is in the open state and at an intermediate time of sheet conveying.

In contrast, when the straight path 82S is selected, the behavior of the sheet may not be stable after the intermediate time of conveying the sheet. For example, at the initial time of conveying the sheet, the leading end of the sheet S moves along the discharging direction of the conveying roller 75 as shown in FIG. 13. Thus, the after-branch sensor 64 can detect the sheet S. Then, when conveying the sheet S advances, the sheet S hangs down under the own weight of the sheet S as shown in FIG. 14 at the intermediate time of conveying the sheet. Thus, the sheet S comes off the sensible area of the after-branch sensor 64 and it becomes impossible for the after-branch sensor 64 to detect the sheet S. The timing at which the sheet S hangs down varies from one sheet to another and cannot be predicted. That is, the after-branch sensor 64 according to the exemplary embodiment is placed at a position where the after-branch sensor 64 can detect the sheet at the initial stage of conveying the sheet and then cannot detect the sheet because of change in the behavior under the own weight of the sheet. Therefore, the reliability when ON continuation check is performed may be decreased.

Then, referring again to FIG. 11, when the straight path 82S is selected, namely, if the cover 12 is open (NO at S411), the ON continuation check process of the after-branch sensor 64 is terminated. This means that determination of a jam using the after-branch sensor 64 is avoided. Accordingly, a jam determination mistake becomes hard to occur.

In contrast, if the cover 12 is closed (YES at S411), it is determined whether the after-branch sensor 64 is turned OFF (S421). That is, as with the before-branch sensor 63, the ON continuation check process of the after-branch sensor 64 is performed. If the after-branch sensor 64 is not turned OFF (NO at S421), the process returns to S401.

If the after-branch sensor 64 is turned OFF before the expiration of a predetermined time (YES at S421), it can be determined that reverse (backward) inclusion into the fixing unit 8 occurs. The routine makes a transition to the flowchart of FIG. 7 and the jam stop process is performed. When the predetermined time has elapsed although the after-branch sensor 64 is not turned OFF (YES at S401), the ON continuation check process is terminated.

Referring again to FIG. 6, after the ON continuation check process of the after-branch sensor 64 is started, the image forming apparatus 100 waits until completion of the ON continuation check process of the before-branch sensor 63 and the ON continuation check process of the after-branch sensor 64 (S107). Upon completion of the ON continuation check process of both the before-branch sensor 63 and the after-branch sensor 64, the jam detection process is terminated.

(Sheet Trailing End Jam Detection Process)

Figure 15:
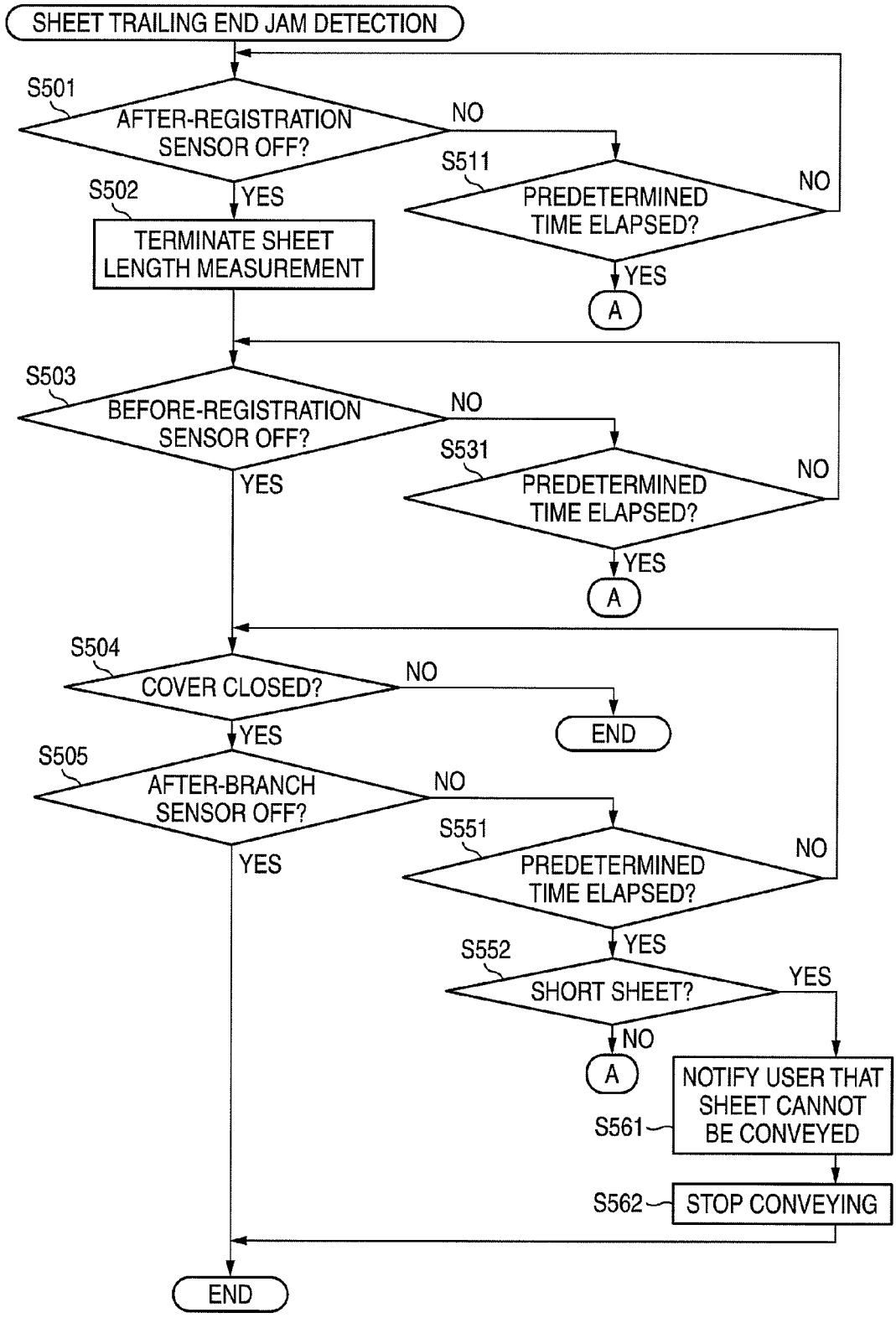
FIG. 15 is a flowchart showing a jam detection process of a trailing end of the sheet.

Subsequently, jam detection process when the trailing end of a sheet is detected (one example of a determination unit and a sheet length determination unit) will be described with reference to a flowchart of FIG. 15. This process is started when the after-registration sensor 62 is turned ON.

First, it is determined whether the after-registration sensor 62 is turned OFF (S501). If the after-registration sensor 62 is not turned OFF (NO at S501), it is determined whether the count time since the point in time at which the after-registration sensor 62 was turned ON ((B) in FIG. 5) exceeds a predetermined time (S511). That is, it is determined whether the time during which the sheet is detected by the after-registration sensor 62 is within an allowable range. If the count time does not exceed the predetermined time (NO at S511), the process returns to S501.

In contrast, if the count time exceeds the predetermined time (YES at S511), it can be determined that a jam occurs in the vicinity of the after-registration sensor 62. Then, the routine makes a transition to the flowchart of FIG. 7 and the jam stop process is performed.

If the after-registration sensor 62 is turned OFF within a predetermined time (YES at S501), a termination command of the sheet length measurement started at S102 is given (S502). Then, it is determined whether the before-branch sensor 63 is turned OFF (S503). If the before-branch sensor 63 is not turned OFF (NO at S503), it is determined whether the count time since the point in time at which the before-branch sensor 63 was turned ON ((C) in FIG. 5) exceeds a predetermined time (S531). That is, it is determined whether the time during which the sheet is detected by the before-branch sensor 63 (between (C) and (E) in FIG. 5) is within an allowable range. If the count time does not exceed the predetermined time (NO at S531), the process returns to S503.

In contrast, if the count time exceeds the predetermined time (YES at S531), it can be determined that a jam occurs in the vicinity of the before-branch sensor 63. Then, the routine makes a transition to the flowchart of FIG. 7 and the jam stop process is performed.

If the before-branch sensor 63 is turned OFF within a predetermined time (YES at S503), it is determined whether the cover 12 is closed (S504) before output check of the after-branch sensor 64. That is, if the cover 12 is open, the reliability of the after-branch sensor 64 is degraded. Then, if the cover 12 is open (NO at S504), determination of a jam using the after-branch sensor 64 is bypassed and the jam detection process is terminated. Accordingly, a jam determination mistake becomes hard to occur.

In contrast, if the cover 12 is closed (YES at S504), it is determined whether the after-branch sensor 64 is turned OFF (S505). If the after-branch sensor 64 is not turned OFF (NO at S505), it is determined whether the count time since the point in time at which the after-branch sensor 64 was turned ON ((D) in FIG. 5) exceeds a predetermined time (S551). That is, it is determined whether the time during which the sheet is detected by the after-branch sensor 64 (between (D) and (F) in FIG. 5) is within an allowable range. If the count time does not exceed the predetermined time (NO at S551), the process returns to S504.

In contrast, if the count time exceeds the predetermined time (YES at S551), it is determined whether the print sheet is a short sheet (S552). Herein, based on the sheet length stored in the sheet length measurement process, it is determined whether the printed sheet is a short sheet.

That is, in the image forming apparatus 100 according to the exemplary embodiment, the interval between the rollers forming the U-turn path 82U is wider than the interval between the rollers forming the conveying path upstream from the conveying roller 75. Thus, the minimum sheet size that can be conveyed on the straight path 82S becomes the minimum sheet size that can be supported in the image forming apparatus 100. However, if a sheet of such a size is actually conveyed into the U-turn path 82U, the sheet remains undelivered in the U-turn path 82U. Consequently, the after-branch sensor 64 remains ON.

The sheet remaining undelivered is a normally printed sheet and unlike a jam, the sheet state is good. Damage to the machine as the operation is continued is little. Then, if the printed sheet is shorter than the minimum sheet size that can be conveyed on the U-turn path 82U (YES at S551), it is determined that the sheet remains undelivered. Then, the user is notified that the user should open the cover 12 and remove the sheet (S561). In the exemplary embodiment, a message as shown in FIG. 16 is displayed on the display unit 41 (one example of an notification unit) of the image forming apparatus 100. This message display enables the user to recognize the sheet remaining undelivered.

The subsequent sheet conveying is stopped (S562). Emergency stop of all operation is not required in stop process in a sheet remaining undelivered unlike stop process in a jam. For example, cleaning process after image formation, etc., may be continued. After conveying is stopped, the jam detection process is terminated. The order of S561 and S562 may be reversed.

In contrast, if the printed sheet is longer than the minimum sheet size that can be conveyed on the U-turn path 82U (NO at S551), it can be determined that a jam occurs in the vicinity of the after-branch sensor 64. Then, the routine makes a transition to the flowchart of FIG. 7 and the jam stop process is performed.

If the after-branch sensor 64 is turned OFF within a predetermined time (YES at S505), the jam detection process is terminated.

Thus, the jam detection process according to the exemplary embodiment avoids jam detection determination (S421, S505) made provided that the after-branch sensor 64 is turned OFF when the cover 12 is open. Thus, for example, at S421, if the after-branch sensor 64 is turned OFF earlier than the predetermined time as the sheet hangs down, it is not determined that a jam occurs. Therefore, determination error of the jam can be suppressed.

In the jam detection process according to the exemplary embodiment, process of determining the open or closed state of the cover 12 is contained in the process loop waiting for the after-branch sensor 64 to be turned OFF. Thus, if the cover 12 is opened during waiting for the after-branch sensor 64 to be turned OFF, jam detection determination can be bypassed in response to opening the cover 12.

Modified Exemplary Embodiments

Modified method for changing the jam determination criterion depending on the open/closed state of a cover 12 will be described.

Figure 17:
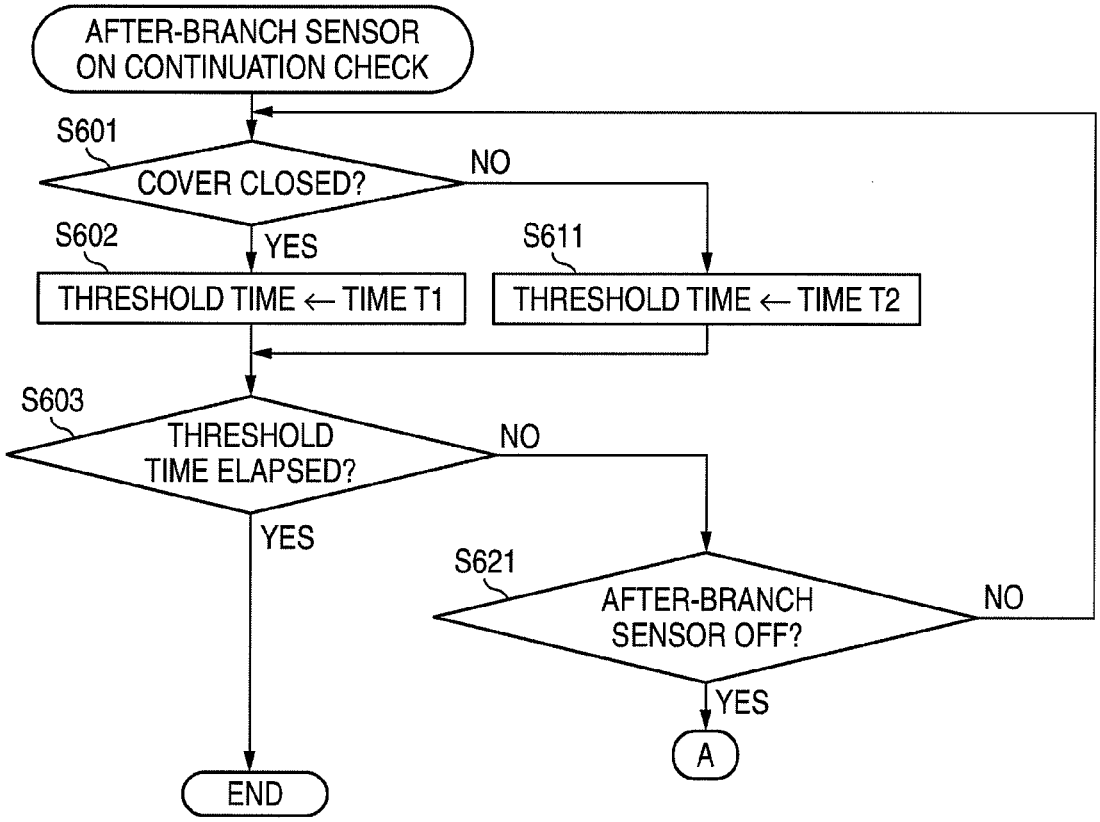
FIG. 17 is a flowchart showing an ON continuation check process of an after-branch sensor according to modified exemplary embodiment of the invention.

In the modified exemplary embodiment, ON continuation check process of an after-branch sensor 64 differs from the above-described exemplary embodiment wherein jam determination is forcibly avoided if the cover 12 is open in that the threshold time to determine a jam is set individually for each of the open state and the closed state of the cover 12. The ON continuation check process of the after-branch sensor 64 in the exemplary embodiment will be described below with reference to a flowchart of FIG. 17.

First, it is determined whether the cover 12 is closed, namely, whether a U-turn path 82U is selected (S601). If the cover 12 is closed (YES at S601), time T1 is set in the threshold time to determine a jam (S602). If the cover 12 is open (NO at S601), time T2 is set in the threshold time (S611).

In the modified exemplary embodiment, the reliability of the after-branch sensor 64 when a straight path 82S is used is low as compared with that when the U-turn path 82U is used. Thus, the jam determination criterion at the open time of the cover 12 is more relaxed than that at the closing time of the cover 12 and a shorter time is set in the threshold time T2 at the open time of the cover 12 as compared with the threshold time T1 at the closing time of the cover 12. That is, the relation of $T1>T2\geqq 0$ is satisfied.

Next, it is determined whether the count time since the point in time at which the after-branch sensor 64 was turned ON exceeds the threshold time (S603). If the count time exceeds the threshold time (YES at S603), the ON continuation check process is terminated.

In contrast, if the count time does not exceed the threshold time (NO at S603), it is determined whether the after-branch sensor 64 is turned OFF (S621). If the after-branch sensor 64 is not turned OFF (NO at S621), the process returns to S601. If the after-branch sensor 64 is turned OFF before the expiration of the threshold value (YES at S621), it is determined that reverse (backward) inclusion into a fixing unit 8 occurs. The routine makes a transition to the flowchart of FIG. 7 and the jam stop process is performed.

As described above, according to the image forming apparatus 100 of the exemplary embodiments of the invention, the after-branch sensor 64 is placed at a position downstream from the branch point and receiving the effect of opening/closing the cover 12. In the jam detection process, when the cover 12 is closed, a determination of a jam based on the fact that the after-branch sensor 64 has detected a sheet continuously for a predetermined time period is made. When the cover 12 is open, the determination is skipped. That is, as the jam determination criterion is changed in response to the open or closed state of the cover 12, the determination criterion responsive to change in the sheet behavior accompanying the open or closed state of the cover 12 is adopted. Thus, determination error of the jam can be suppressed. Since the determination criterion can be changed, the substance of the determination criterion may be designed appropriately according to placement of the sensors and flexibility of the placement of the sensors can be enhanced. It is not necessary to extend the sheet discharging path or increase the number of sensors to avoid the determination error. As a result, it is possible to reduce the size of the image forming apparatus 100.

In the image forming apparatus 100, the before-branch sensor 63 is placed at a position downstream from the fixing unit 8 and upstream from the branch point, namely, at a position not receiving the effect of opening/closing the cover 12. A developer image is unfixed on the sheet conveyed to the fixing unit 8 and a jam in the fixing unit 8 has a high probability of contaminating the apparatus. As the before-branch sensor 63 is placed just after the fixing unit 8, a jam in the fixing unit 8 can be detected earlier and more reliably.

The above-described exemplary embodiment is not limited. Various modifications can be applied to the invention without departing from the scope of the invention. For example, the invention can be applied not only to a printer, but also to a device including an image forming function, such as a copier, a multifunction device, or a facsimile machine. The image forming system of the main unit 10 is not limited to electrophotography and may be ink jet. The image forming function or system may be able to form a color image or may form only a monochrome image.

In the above-described exemplary embodiments, the after-branch sensor 64 is positioned at a place where the after-branch sensor 64 enters a state in which it cannot detect a sheet because of change in the behavior of the sheet although it can detect the leading end of the sheet when the cover 12 is open. Thus, the jam detection process avoids jam detection determination (S421, S505) made provided that the after-branch sensor 64 is turned OFF. However, any other process may be avoided depending on placement of the after-branch sensor 64. For example, if the after-branch sensor 64 is positioned at a place where the after-branch sensor 64 cannot detect the leading end of the sheet either when the cover 12 is open, jam detection determination made based on the output signal of the after-branch sensor 64 may always be avoided.

What is claimed is:

1. An image forming apparatus comprising:

an image forming unit that forms an image on a sheet;

a first sheet discharging path that reverses a traveling direction of the sheet passed through the image forming unit so as to discharge the sheet;

a cover, which is openable and closable with respect to the image forming unit, and which forms a part of the first sheet discharging path when the cover is in a closed state;

a second sheet discharging path, which is formed when the cover is in an open state, which is branched from the first sheet discharging path, and which discharges the sheet passed through the image forming unit without reversing the traveling direction of the sheet;

a sensor, which is positioned downstream in a conveying direction of the sheet from the image forming unit, and which detects a passage of the sheet; and a determination unit that determines a jam based on a detection result of the sensor, the determination unit changing a determination criterion of the jam in accordance with the open or closed state of the cover, wherein the determination unit relaxes the determination criterion of the jam when the cover is in the open state as compared with the determination criterion when the cover is in the closed state, and wherein the determination criterion of the jam when the cover is in the open state is that a jam is not determined when the sensor has continuously detected the sheet for a predetermined time period which is shorter than a longer predetermined time period of the determination criterion of the jam when the cover is in the closed state.

2. The image forming apparatus according to claim 1, wherein the sensor is provided at a position, in which the sensor can detect a leading end of the sheet when the cover is in the open state, and in which the sensor cannot detect the sheet in accordance with a change in the behavior of the sheet after detecting the leading end of the sheet.

3. The image forming apparatus according to claim 1, further comprising:

a fixing unit; and a second sensor, which is provided in a position between the fixing unit and a branch point of the first sheet discharging path and the second sheet discharging path in the sheet conveying direction, and which detects the passage of the sheet.

4. The image forming apparatus according to claim 1, further comprising:

a sheet length determination unit that determines whether a length of the sheet is less than a minimum sheet length that can be conveyed on the first sheet discharging path when the cover is in the closed state; and a stop unit that stops subsequent sheet conveying if the sheet length determination unit determines that the length of the sheet is less than the minimum sheet length.

5. The image forming apparatus according to claim 4, further comprising:

a notification unit that indicates that the sheet remains undelivered in the first sheet discharging path if the sheet length determination unit determines that the length of the sheet is less than the minimum sheet length.

* * * * *